US007341405B2

(12) United States Patent
Gunther

(10) Patent No.: US 7,341,405 B2
(45) **Date of Patent: *Mar. 11, 2008**

(54) IN-SITU PILINGS WITH CONSISTENT PROPERTIES FROM TOP TO BOTTOM AND MINIMAL VOIDS

(76) Inventor: Johan M. Gunther, 1247 Lincoln Blvd. #140, Santa Monica, CA (US) 90401

( * ) Notice: Subject to any disclaimer, the term of this patent is extended or adjusted under 35 U.S.C. 154(b) by 0 days.

This patent is subject to a terminal disclaimer.

(21) Appl. No.: 11/353,670

(22) Filed: Feb. 13, 2006

(65) Prior Publication Data

US 2007/0189859 A1 Aug. 16, 2007

(51) Int. Cl.
*E02D 3/12* (2006.01)

(52) U.S. Cl. ..... 405/240

(58) Field of Classification Search ..... 405/236, 405/240

See application file for complete search history.

(56) References Cited

U.S. PATENT DOCUMENTS

| | | | | |
|---|---|---|---|---|
| 4,286,900 | A | 9/1981 | Sugimoto et al. | |
| 4,461,362 | A | 7/1984 | Staggs et al. | |
| 4,940,366 | A | 7/1990 | Suzuki | |
| 5,228,809 | A | 7/1993 | Yoshida et al. | |
| 5,542,786 | A | 8/1996 | Blum | |
| 5,944,446 | A | 8/1999 | Hocking | |
| 5,967,700 | A | 10/1999 | Gunther | |
| 6,116,819 | A | 9/2000 | England | |
| 6,238,142 | B1 | 5/2001 | Harsch | |
| 7,090,436 | B2 * | 8/2006 | Gunther | 405/240 |

FOREIGN PATENT DOCUMENTS

| | | | |
|---|---|---|---|
| EP | 0411560 | B1 | 5/1994 |
| JP | 358127828 | A | 7/1983 |
| JP | 402209519 | A | 8/1990 |

* cited by examiner

*Primary Examiner*—John Kreck
(74) *Attorney, Agent, or Firm*—Donald D. Mon

(57) ABSTRACT

A method to make an in-situ piling in which a dry binder and water are injected into the situs of an intended piling. A rotary tool is inserted into the soil which as it descends into the situs and exits it, mixes the soil, binder and soil along with the air used to inject the binder, reducing the size of binder particles and rendering the resulting mixture sufficiently fluid that much of the air can percolate from it. The water is supplied in such amount as to reduce the unit strength of the ultimate cured piling, but sufficiently strong and reliably consistent in its physical properties.

14 Claims, 3 Drawing Sheets

IN-SITU PILINGS WITH CONSISTENT PROPERTIES FROM TOP TO BOTTOM AND MINIMAL VOIDS

FIELD OF THE INVENTION

Process to improve the uniformity and predictability of structural properties of in-situ pilings.

BACKGROUND OF THE INVENTION

Supports for and reinforcements of above-grade structures are often referred to as "piles" or "pilings". Also, such structures are often referred to as "supports". The terms piles, pilings, and supports will for purposes of this invention be regarded as synonymous. Further with regard to these terms, the term piling in its general sense is a structure that gives a known vertical response to a load exerted directly on top of it. The familiar construction of a beach-side pier relies on this property. The pier structure is simply built so as to be tied to the top of the pilings and is supported at its underside by the pilings.

A support of the type contemplated by this invention is below grade and utilizes as part of its composition the soil whose volume it replaces. In-situ pilings are often spoken of as supports". These terms are regarded as synonymous and will be used interchangeably. The structure of an in-situ piling contrasts with conventional supports, which are generally lengths of tree trunk grown and prepared, or cast concrete shapes manufactured elsewhere or at this site from foreign material.

Conventional pilings and supports preferably are driven or otherwise placed in direct contact with bedrock or other supporting structures. If the bedrock or other structure is too deep, then reliance for support is placed on the "skin friction" between it and the surrounding soil. The inherent advantage of the continuity of an in-situ piling with its surrounding soil is evident. Its equivalent of skin friction is a merger of the surrounding soil with the enhanced material of the in-situ piling-a very substantial difference which is advantageous whether or not the in-situ piling reaches bedrock or other supporting structures or relies on the engagement (for convenience sometimes referred to as skin friction) of the in-situ piling with its surroundings. In fact, the in-situ piling does not have a skin in the same sense as a conventional piling has.

Conventional pilings, although in use for many decades, are limited in their utility. For one thing they must usually be made elsewhere, carried to the work site, and then somehow inserted into the ground. Familiar examples are percussive pile drivers, vibrational insertion systems, and excavation of shafts into which the piling is inserted. These are all very costly, but if an optimally consistent structure, whose unit properties are known, constant, and maximum literally from inch-to-inch is required, these are often the best available solution, and they are in fact widely used.

The costliness of conventional pilings is an economic limitation on their application, but for installations with critical properties they are in widespread use. However there exist many applications for affordable piling technology which, while the ultimate unit strength of cement or wood pilings is not necessary, still require predictable and suitable structural properties. These would often be used instead of conventional pilings, provided their properties were sufficient, predictable, and affordable. The term "affordable" includes such considerations as the cost of materials, the cost of manufacture of the piling structure, and the cost of transportation and labor and its installation, all related to a sufficient strength.

This situation has not gone unnoticed. A first thought is to manufacture the piling on-site, or near to it. If this means casting a cement piling at a location adjacent to the site, the savings would be obscure at best, because all of the ingredients (usually cement and aggregate) would still have to be brought to the site and a manufacturing process set up.

This invention proposes the use of an in-situ piling (or column) in which only water and binder (often cement or lime or both) would have to be brought to the site. A boring-mixing type tool would be brought to the site, there to dig into the ground, and mix water and binder into the existing earth material. The intended result would be a sub-grade column on which an above-grade structure could reliably rest, existing in the earth without having been manufactured off-site and without having been driven into place, and without the need for an open shaft to be formed.

Several principal arrangements have been proposed for this purpose. Perhaps the oldest is often called the "dry method", in which a tool bores into the ground and while so doing adds a binder to the existing material which reacts with water already existing in the soil, with it to form a cementitious column. The shortcomings of the dry method are evident. There may not be enough water already there for the purpose. Still, the dry process has been widely used, and still is in use to this day.

Another process, commonly called the "wet method", has also been widely used. In this method the binder is provided as a slurry of water and binder, which is injected into the ground while the tool bores into it. There are considerable disadvantages in this system including wastage of binder, variability of the properties of the piling from depth to depth, and clean-up costs, which can be very large.

There have been previous efforts to overcome the disadvantages of the wet and dry methods. One is familiarly called the "Modified Dry Method" in which the soil is preconditioned with water as the tool moves down, and cement is added on the way up. This is the subject of applicant's U.S. Pat. No. 5,967,700 issued Oct. 19, 1999, title "LIME/CEMENT COLUMNAR STABILIZATION OF SOILS".

Another previous effort is European patent No. 0411 560 BI granted May 4, 1994 to Trevi S. P. A. (referred to herein as the "Trevi" patent). This is an effort to produce an in-situ piling with only sufficient water provided for "humidification". As will become evident, this patent leads away from the concept of this invention.

The above criteria do not attend to the effects on the ultimate product of two substances which are ultimately involved, namely air and water. The only known way to inject the dry binder into the sub-surface region is by entraining it in a pressurized stream of air. Unavoidably this means injecting very substantial volumes of air into the formation. There, unless it can escape, it can form air pockets in the piling which reduce the strength of the column itself.

Even worse, it adds to the volume of the mix, and a large heaving of surrounding soil will be formed. This is a very serious consequence. In railroad construction, for example, it has been found to shift the track bed sideways by as much as 10 feet. To counter this effect, a large weight is often placed on top of the heaved adjacent areas. For example a thick layer of rock which compresses the intubated soil and surroundings holds the ground down and allows the air to escape. After this has occurred, the rock is removed. This is a very costly procedure. It would be far better not to have the heave in the first place.

This invention provides a means to dispose of the air on an on-going basis. It is an object of this invention to provide an in-situ piling which causes at most a minimal amount of expansion while being mixed.

The way to do this is to provide an environment in which the air will readily percolate out. In this invention this means sufficient fluidly (or fluidization) of the mixture. In turn, in this invention this involves the use of excess water for fluidization.

In processes that involve manufacture of cementitious solids by reaction with water, it is general knowledge that there is an amount of water necessary for complete hydration of the binder (the stoichiometric amount). It is also known that water in excess of this amount may and usually does result in a cured solid with less unit strength than if only the stoichiometric amount had been used. Finally it is possible to "kill" the cement with a great excess of water resulting in a fatally weak structure.

Accordingly, it is a surprising concept that by adding what would ordinarily be an excessive amount of water, the resulting liquefaction enables the air promptly to percolate out, enables the binder to be distributed so as to give each region the correct amount of binder for the ultimately intended effect, for the piling to be formed without abrupt regional inconsistences, and for the resulting piling to have a known and sufficient strength from top to bottom.

The counter-intuitive concept of this invention is to accept a reduction in the unit strength of the resulting column in exchange for a resulting elimination of most of the air with its adverse consequences, thereby providing a continuous column without abrupt discontinuities between soil layers, with predictable minimum strength at every region from top to bottom, with homogeneity at more stations.

The process of this invention rotates a tool into and out of the ground, and during this action adds water and binder in a defined manner and amounts. One is entitled to ask what can be new in the combination of these simple acts. This question is answered in large part by examination of the products produced by already known processes. While all of the known processes can produce an acceptable piling for at least some applications, generally they are unattractive for many applications. The products they make in some soils and conditions are found to be deficient or unreproduceable in major properties in other soils, especially from depth to depth. It is an object of this invention to provide a process for making in-situ pilings with consistent and predictable properties from top to bottom, with known and sufficient unit strength, affordability of machinery, and reduced costs of materials, labor and capital equipment.

Some of the criteria for selecting an acceptable type of piling are how and where the column (piling) is to be made, what is its intended use, what are the properties of the soil in which it is to be formed, part of which will be used for the piling itself, what is the cost of making the piling, and what is the amount of binder needed to accomplish the desired objectives. When pilings of higher strength are desired, for example, larger quantities of binder can be used (at greater expense). The cost includes that of the very substantial machinery needed for its manufacture, the ability to place the machinery where it is needed at the site, the cost of labor to run the machinery, the speed of production, and the relative cost of the materials used to make the piling.

As to the materials, the costs of existing soil and water are negligible provided that the existing soil is in acceptable condition. The same is not true for the cost of the binder. It is the practice of most in-situ processes to use considerable excess binder to be certain that enough is present at all locations in the column. Certainty of the minimum properties of the column at all of its levels and regions could enable a designer to use only the amount of binder actually needed for suitable minimum properties throughout, plus the lowest reasonable margin of safety. If he does not have such assurance, he would normally provide an extra amount of binder, and then often still would add a wishful additional excess of it. Clearly, reduction of uncertainty can result in large savings in the cost of the binder, which is a major expense. pressure existing at different depths. This aids in providing a mixture which enables air readily to escape by percolation. It is evident that proper binder concentration at all levels is important to making an optimal column.

As to this, there is a surprising number of variables that can affect the ultimate choice of the amount of binder to be used. Perhaps the most profound variable is the consistency of the formation in which the column is to be made from top to bottom. It is not unusual for a formation within perhaps only 30 feet of depth, to include lightly consolidated material near the surface, very hard layers immediately underneath it, and perhaps a soft clay underneath them. The requirements for water and for cement can vary remarkably among these, and yet the strength of the ultimate column should be as nearly uniform as possible from top to bottom. A generally unappreciated consideration regarding the need for binder is the relative efficiency of the kinds of soil to act as aggregate that will be bound by the binder to form the ultimate solid. For example, sandy soil is very efficient in its binding with cement. Clay is very much less efficient and needs more cement. Pulverized soil is more efficient than soil fragments of hard consolidated material.

If one is to form a piling in soil in which several layers of different types of structure exist, and desires to provide enough binder to function sufficiently for all of them, he could provide binder at a constant rate suitable for the layer least efficient in its use of cement. Then the binder concentration would be the same at all depths. This can be a very significant waste, because the correct objective of the piling is not to have a constant binder concentration, but instead to have a known minimum strength along its entire length. Much of the column then could contain excess cement.

If the soil has been investigated as it should be, then the amount of binder needed at respective depths can be calculated, making significant savings. As will be shown, this is only the first of a number of criteria that can and should be considered.

The objective would seem to be to correlate the supply of binder to the need at different depths. This overlooks how the powdered (or granular) binder is supplied. It is brought to the machinery in bulk transport and held for discharge from a holding tank. Interestingly, the amount of binder being dispensed is as a practical expedient learned not from a flow-sensinq device, but from continuous weighing of the binder tank with its contents. Flow sensing devices are speedily destroyed by abrasive binder. Surprisingly accurate measurements are readily attained from the weighing operation. The diminishing weight of the tank and its contents is a sufficient measure of the dispensed binder.

The binder is conveyed from the tank through a hose extending from the tank to the top of a tower, and then down to the tool, under propulsion of a pressurized air stream. The air enters the bore along with the dry binder. There is usually at least a 40 foot flow path from the tank to the tool. The binder is fed into the air stream at a rate determined by a feed mechanism such as a star wheel located at the tank. If one were to "tailor" the flow, it means coordinating the need for a particular amount of binder at some depth remote with a feed mechanism located at least 40 feet upstream. It is not a reasonable option to place the feed mechanism any closer to the point of use. However, this can be calculated and programmed effectively to deliver a desired amount at the point of delivery, knowing the rate of flow.

An objective of this invention is to provide the resulting in-situ mix with a binder/aggregate strength that is as uniform and known as possible from depth to depth, with a fluid-like consistency, having fewest air pockets and clumps of aggregate.

This is far from a minor matter. The ability to predict the properties of the piling from top to bottom with a minimum safety factor can significantly reduce the amount of binder actually required compared to the amounts used in the wet and dry methods, and also relative to dry methods in which water is also added. It is an object of this invention to produce a column which when mixed and left to set up is in an amorphous condition resembling a very wet mud, and which cures to a piling with reasonably consistent minimum properties throughout.

In addition, by providing the binder in part in the downward tool movement and in part in the upward movement, there is an averaging out of the supply, further to assure proper amounts at the various depths.

Saving of binder has environmental consequences far beyond the expense itself. The manufacture of cement consumes a large amount of fuel, producing greenhouse gases. This invention reduces these emissions because of its use of less binder.

Such a near-homogeneous pre-set condition is not fully accomplished in the known art. Especially in clay type soils, the motive power required to accomplish mixing in the bore is sometimes so large that very powerful and excessively heavy equipment must be provided for it to work. Even these frequently stall. In addition, the weight of the equipment precludes its use on soils which will not support very heavy loads, thereby reducing the scope of useful applications of the process when equipment needed cannot be accommodated on the site. By providing a fluidized mix, the tool works against a lesser resistance.

It is an object of this invention to provide a process whose power needs can be met with the use of less powerful and lighter weight machinery, machinery so light that it can be used on soils so weak as just strong enough for a man to walk on. This is a profound advantage, for example in road building, levee repair, and railroads. The process is therefore useful in a very wide range of applications.

This invention provides yet another advantage, that of certainty of the ultimate properties of the piling. It is instructive to compare the available techniques and results of tests of various kinds of in-situ pilings.

Pilings made with the dry method rarely show consistency from top to bottom. Often regions of these pilings readily fragment. These pilings usually can not be pulled out of the ground for testing because they are so fragile that they break before they can be extracted. Also they cannot be cored, because the piling often powders, where it is cored. Pilings according to this invention can almost never be pulled out except as a body, with the use of cast-in-place rods. However they can be sampled by core drills. Thus pilings prepared by the dry method can be relied on only for properties related to their most unfavorable parts, while pilings according to this invention can be relied on for predicted, uniform properties over their entire length and importantly, can be sampled.

The properties of pilings made by the wet method frequently vary along the height of the piling, and are often wastefully produced. The soil and wastage they create is expensive.

Still another advantage of the fluidity of the mixture is that it enables the blades and also the outriggers to cut and macerate such organic material as may be present. For example, many levies have grown trees on them, and their roots may be in the situs where the piling is to be formed. The fluidity and suitable shape and size of the confronting edges of the blades and outriggers enable this material to be reduced to sizes which do not impair the properties of the cured piling.

BRIEF DESCRIPTION OF THE INVENTION

This invention utilizes a rotary mixer-injector adapted to bore into the ground when rotated in a first direction, and to mix and assist in compacting the material while withdrawing from the bore, rotating in the opposite direction. During these movements binder is injected both while going down and when coming up. The amount of binder injected is appropriate to soil properties at respective levels. By injecting the binder while moving in both directions, the concentration of binder at various levels is averaged out to reduce, and even eliminate variations from the supply which otherwise might result in local imperfections in the column and variation of back pressure existing at different depths. This aids in providing a mixture which enables air readily to escape by percolation. It is evident that proper binder concentration at all levels is important to making an optimal column.

A major consideration is that of proper mixing of ingredients and a uniform consistency of product from bottom to top. This means assuring reduction of too-large sizes of aggregate to a suitably lesser size, and percolation of air that was injected along with the binder.

The tool includes blades which slant for purposes to be described. On the way down, they slice into the formation to part it. This is accompanied by an injected supply of water which is available to enter the parting space made by the blade to lubricate the blade, and to form an aqueous interface between the developed faces of the formation. This interface is, of course, quite thin. At most it has the thickness of the blade, but it exists although it diminishes with time and departure of the blade. However, it does function for its purpose Without this water, the material would simply collapse back on itself, and the blade would not have made much of a difference. With this wetted and even disrupted interface, the material will have a discontinuity at the interface which is advantageous when the tool is reversed and brought back toward the surface. On the way down it creates a thread-like pattern of soil bounded between faces of the discontinuity which weakens the soil structure at its location.

According to another feature of the invention, the blades have a confronting edge on their reverse side that directly engages the parted material to disrupt and stir it when the rotation of the tool is reversed.

According to a preferred but optional feature of the invention, the rotational speed and advancement of the tool (and its blades) are such that during withdrawal of the tool, the confronting edge will generally strike the material between the interfaces, optimally to disrupt the formation, thereby to assist a thorough mixing of the materials in the bore. Also when done properly it reduces the size of particles to no larger than a small marble. The resulting circulation of the material assists in making the resulting piling more uniform by causing a mixing locally convective flow of material which stirs the mixture for a significant distance above and below the blades. This eliminates abrupt changes in the composition of the piling from top to bottom which might exist as discontinuities or regions of lesser strength when adjacent layers of soil have appreciably different properties, such as sand next to slate.

According to yet another feature of the invention, the rate of rotation of the tool is maintained at a rate sufficiently high to assure that the material does not merely stick to the vanes. At slower rates, either the material could simply turn with the vanes, or the vanes could be stalled. A properly high rate of rotation combined with a proper rate of advance of the tool enables the use of lighter equipment, and provides a more completely mixed product. This higher rate of rotation and the increased energy exerted in the bore is enabled by the provision of surprisingly large quantities or water. Among other advantages of this water is the lubrication it provides to the vane for this purpose According to a preferred but optional feature of the invention, the rates of rotation and advancement are such that on the way down the vanes can cut into the formation, leaving an interface. When two blades are used, two identical interfaces will be formed, spaced apart by an axial distance determined by their dimensions. On the way up, the rates of rotation and withdrawal are such that the confronting edges will preferably impact material especially between the interfaces, so as to disrupt the formation and leave it in condition for the vanes to exert their further mixing action. Ultimately the consistency preferably resembles grated cheese, with particles no larger that a small marble.

It is an optional feature of this invention that the rate of rotation on the way up exceeds that of the rate on the way down, thereby increasing the impact forces and improving the mixing of the materials.

Another feature of this invention is its reduction of unit strength of material in favor of uniformity, absence of discontinuities and effective reduction in size of particles of the aggregate-soil. These improved factors enable the production of a reliable column generally with good or better design strength because of the predictability and reliability of the resulting piling. This is accomplished by the use of surprisingly large quantities of water, significantly more than would be required for hydration.

The consequence of all of this is a thoroughly mixed column with good properties and without local discontinuities from top to bottom.

This invention offers another opportunity to improve the function of the installed column. It will be recalled that a driven piling is supported either by resting on a so-lid surface below it, or by skin-friction, meaning the cohesion between the wall of the column and the surrounding structure.

If it is the latter, then the closest possible relationship between the outside surface of a piling and the inside "surface" of the bore is critical. If it were only a lubricated pair of surfaces, there would be no skin friction.

According to this invention, the material of the column at its outer boundary is mixed with the inner boundary of the structure, whereby to form a transitional region rather than an abrupt pair of surfaces, thereby greatly increasing the shear-type resistance at the boundary, significantly increasing the "hold" of the surrounding structure on the pilings.

Still another feature of the invention is the provision of the ultimate mixture with a consistency that hastens the escape of air by percolation.

DETAILED DESCRIPTION OF THE INVENTION

Figure 1:
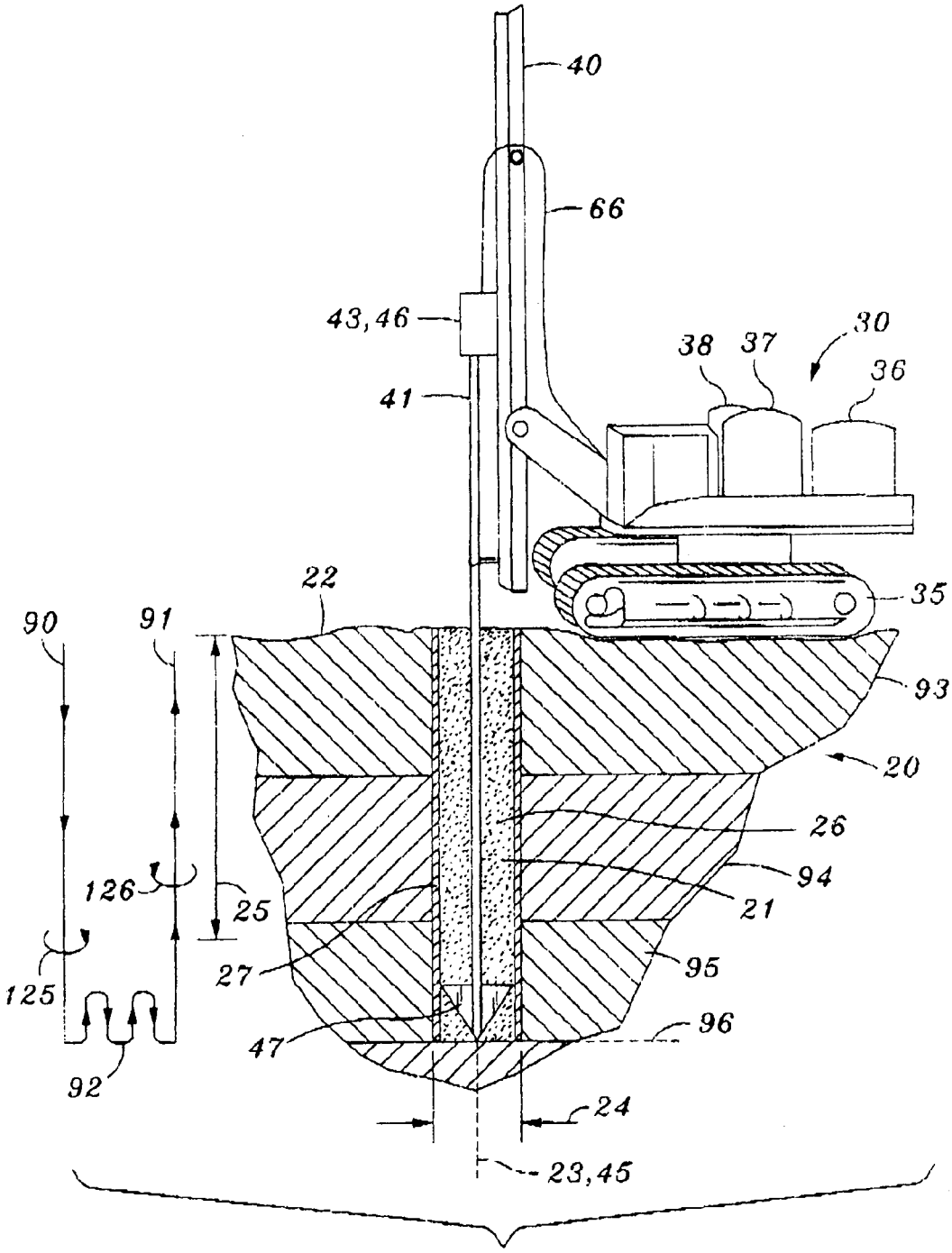
FIG. 1 is a vertical axial cross-section, partly in side view, with an accompanying graphic.
Figure 2:
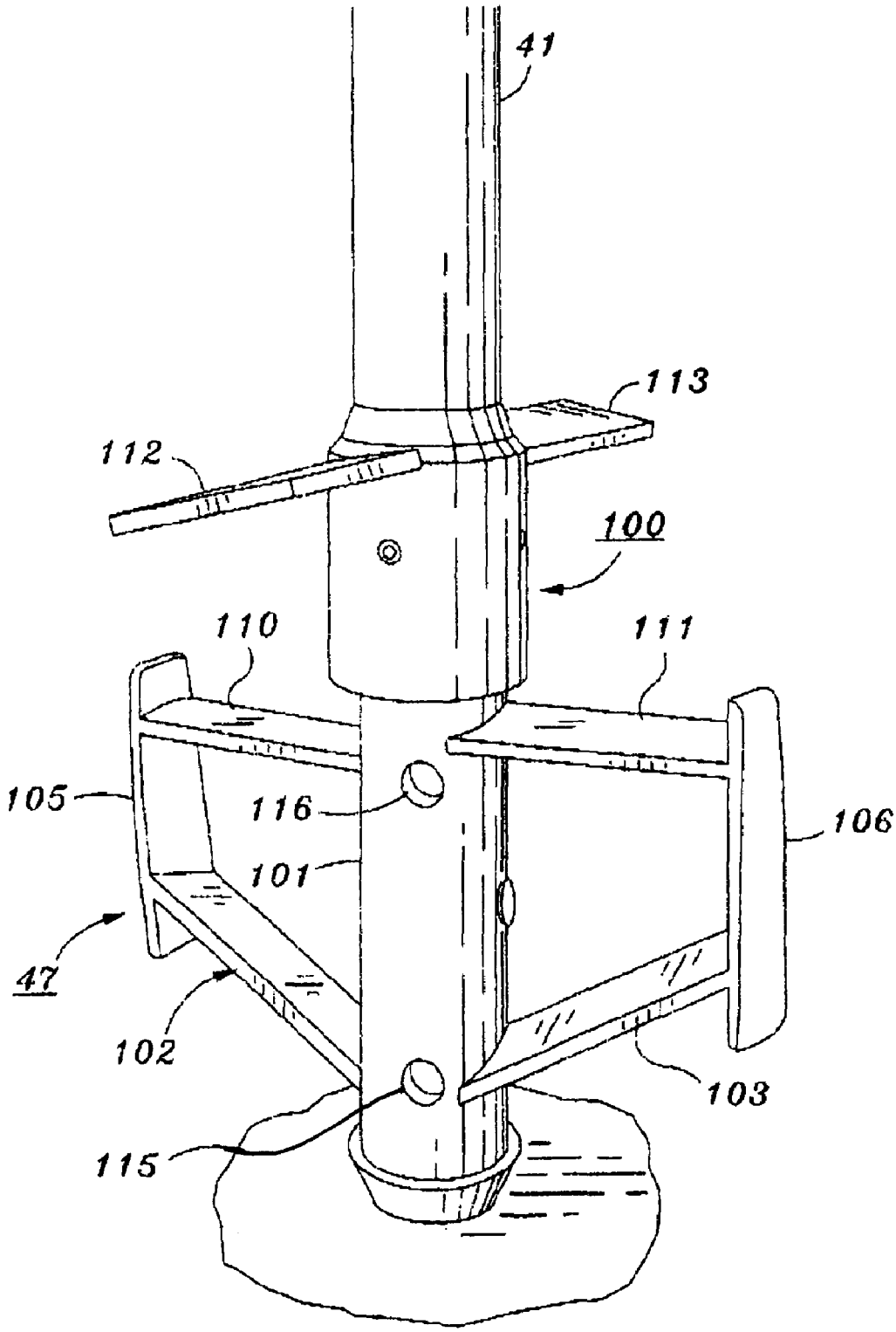
FIG. 2 is a perspective view at the side of a tool useful in this invention.
Figure 3:
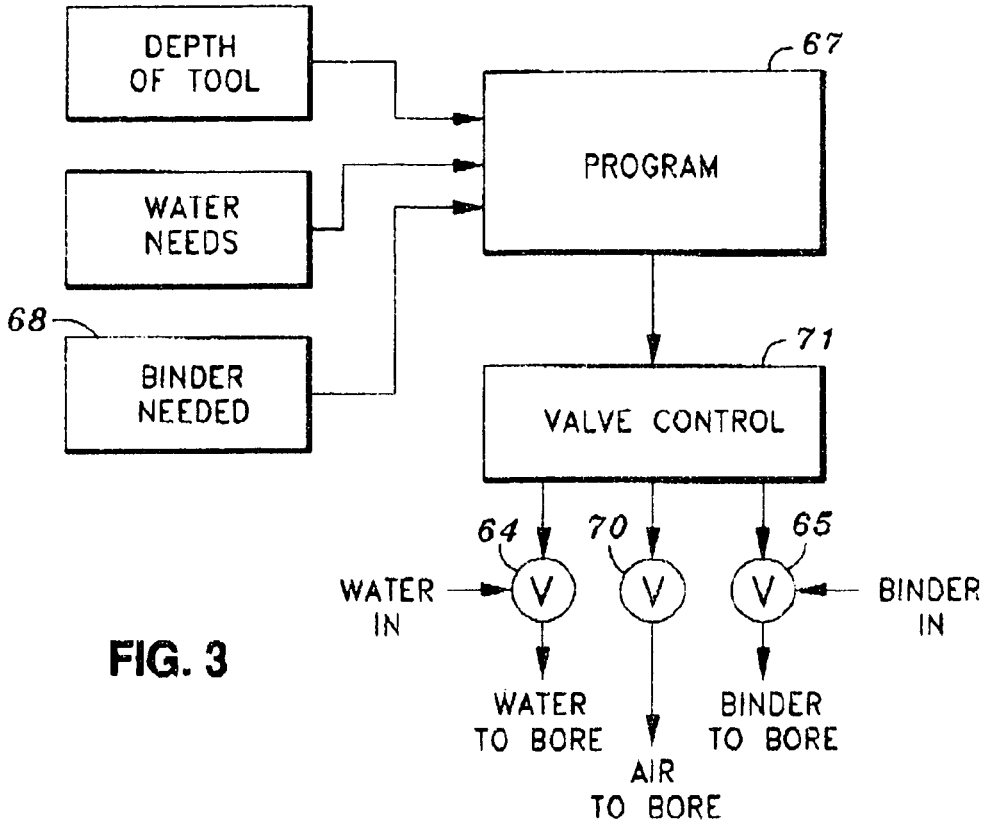
FIG. 3 is a flow chart.
Figure 4:
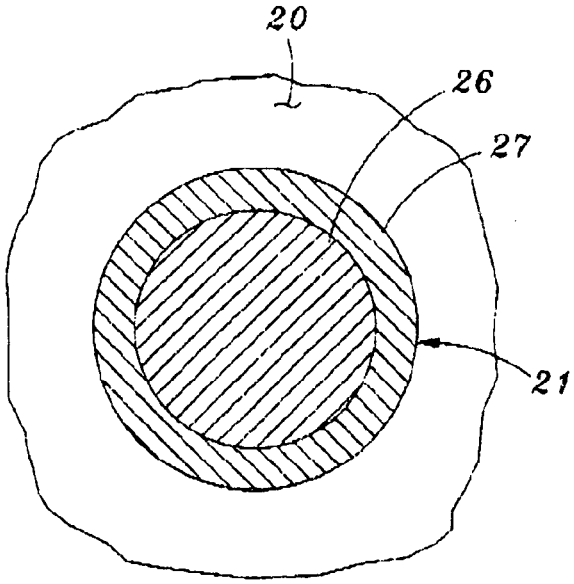
FIG. 4 is a lateral cross-section of a completed in-situ piling.

The ultimate objective of this invention is to provide in a surrounding structure 20 an in-situ column (or piling) 21. The piling is mostly or entirely below the surface 22, with a central vertical axis 23, a diameter 24, a depth (or height) 25, a solid core 26, and a generally cylindrical transitional layer 27 around the core constituted in part of the material of the core and in part of the structure, continuous with both of them.

As to transitional layer 27, it is commented that the surrounding structure does not include binder. The core itself comprises in addition to the binder, the soil that is already there. Accordingly, the transitional layer comprises a region whose composition lies between that of the core and that of the structure. However, it is a continuous structure common to both, and there is not a sharp boundary of properties of the piling and the structure.

The process of this invention is started by bringing to the situs manufacturing equipment 30. This equipment is used sequentially to make in-situ pilings, starting on a previously existing surface 22 of soil structure 21.

Such equipment generally includes a track laying vehicle 35 which can carry or tow a water tank 36 and a binder tank 37 and an air tank 38. These are, of course, re-supplied continually from time to time as their contents are used.

A tower 40 is supported by the vehicle. The tower mounts a powered rotary drive shaft 41. A bearing (not shown) in some industries called a "kelly bushing", is driven by a power source 43. It engages the shaft rotationally to drive it.

Shaft 41 rotates around central axis 45, which is coincident with central axis 23. It is moved axially relative to the surface by any desired type of actuator 46, such as a piston cylinder combination. The objective is to move the shaft downwardly to force a tool head 47 downward into the soil and to withdraw it from the soil, all while mixing the binder, aggregate and water.

The above is a commonly-used arrangement to rotate the shaft and to move the tube up and down to do its work.

The method of this invention comprises the selective injection of water and of binder into existing soil, vigorously mixing it in such a way as to reduce the binder to consist of particles of limited size, and with excess water to create a liquified mix which is sufficiently fluidized that much of the air used to introduce the binder can percolate out of the piling before it sets, thereby to produce a reliable piling of assured strength throughout its entire depth, even though its unit strength may and usually will be less than if less water had been used.

A water valve 64 controls the rate of flow of water to the tool.

Control over vertical movement of the tool head is exerted by a directional thrust control valve which selectively directs pressurized fluid to force the tool to move upwardly or downwardly at a rate and direction controlled by the valve.

The system is further controlled by a directional rotation control valve which selectively controls the direction and rate of rotation of the tool by controlling its power source.

These valves and actuators are common devices and require no detailed description here.

A binder supply feeder acting as a valve admits dry binder to a feed conduit 66. It may be such as a star wheel feeder whose rate of feed is proportional to its rate of rotation. It is under control of a program 67 which responds to the depth and the known amount of binder at that depth as known from binder needed data 68.

An air valve 70 controls the flow of air under pressure to the tool. It is under control of a controller 71. The feed of binder from feeder 65 mixes into the stream of air from valve 70. Assuming a constant flow of air, the supply from feeder 65 will be associated with the anticipated amount of binder at a zone in the bore that will be reached within a known period of time, namely the time it takes for the binder to arrive at the tool at a known depth.

With knowledge of the need for binder at a given depth, along with knowledge of the pipeline time for passage from the feeder to the tool, a program respective to a given soil pattern can readily be derived.

Analysis of the results of recent and long ago in-situ pilings has disclosed that older practices often worked reasonably well in sandy and relatively uniform soft soil. There is a large area in which such soils exist and the advantages of this invention are of lesser value. Still, in some sandy soils the injected water drains quickly. If so, then it is not available when hydration or percolation of water is needed, namely at and after the time when the binder is injected.

It should be remembered that the round trip of the tool of this invention for a piling about 60 feet deep can be as much as 5 to 6 minutes. This means that water injected at the top at the time of first entry will at least partially be drained away when the tool returns to the surface.

When binder is delivered only during the downward or only during in the upward movement of the tool, the mixture can vary from depth to depth, in part due to the different conditions into which it is injected. For example, the deeper the bore the greater is the hydrostatic pressure resisting the injection of air and the binder. Also, when the soil is stirred in only one direction, the material in the bore is less stirred and mixed.

In addition there may be changes in the local waters content between passes of the tool.

To counter this effect, it has been found beneficial to inject only part of the binder on the way down, and the remainder on the way up. Similarly but less importantly, the water to be supplied may also be divided between the upward and downward legs. This results in an averaging of the supply to the various depths and the presence of water and binder where and when they are needed at the time they are locally mixed.

The supply program may be devised to supply the desired totals of water and binder to respective depths where the soil conditions are different from one another. The data is derived from earlier subsurface investigations such as core samples. Such programs are made available to the operator, usually on a visual display designed to show the amount intended to be delivered at some depth, and the amount actually being delivered. The program must account for the pipeline travel time in the air-binder supply conduit from the source to the tool-usually a few seconds. This is a matter of routine programming.

The air is a necessary evil, because there is no other practical means to deliver the powdered binder. However, in the bore while the process is carried on, the air occupies volume that results in swelling of the material being mixed, and unless it is released it can result in pockets in the piling. Also, unless it is continuously released, it may gather in such amounts as to cause the material to heave and swell thereby to cause disruption of the surface and also of adjacent areas. Further, if the release is too abrupt it can cause the material at the top of the bore to be projected into the air, leaving a crater at the top to be filled later at considerable expense and annoyance.

Accordingly, the mix must be sufficiently fluidized as to permit the air continuously to percolate to the atmosphere. This fluidization is not without its benefits. An aerated mix is more readily stirred. As will be seen, the enabled improved stirring results in better reduction of particle size and a much more uniform mix, as well as a reduction of the energy needed to form the piling, thereby enabling the use of lighter equipment.

Uniformity of mix in the sense of reduction of particle size and uniform distribution of binder and water is only one advantage. Another is the convection-like internal flow of the mix caused by vanes. This is especially valuable where the piling goes through two contiguous formation layers, for example from clay to shale to sand.

With conventional dry mixing, at the intersection of two layers there is often a visible physical discontinuity. With this invention the regions where then intersect is invaded from above and below, whereby to form a transition zone between them. In effect this carries the uniformity of the piling from vertical zone to vertical zone. The piling can then be designed with knowledge that there is a known minimum strength for the full length of the piling, still having provided only the amount of binder needed for each type of aggregate. The cost savings can be significant.

This convective flow, combined with the effect of the outriggers also results in an improved transition region area between the outer region of the piling and the adjacent surrounding soil. The outriggers localize the mixing action in this region and will stir some of the surrounding soil into the piling mix, thereby creating an improved homogenous transition region that is incorporated into the surrounding soil. Extraction or excavation of a cured piling clearly shows this transitional region.

FIG. 1 is a more detailed showing of the tool head 100. It is mounted to a central shaft 101 that can be coupled to drive shaft 41 from power source 43. Vanes 102, 103 are welded to shaft 101 and extend at an angle away from the horizontal. About a 15-20 degree angle is useful.

Preferably but not necessary the vanes are flat blades, perhaps steel plate ½ inch thick, or perhaps beveled at their confronting edges, which make an angle of about 15 degrees with a theoretical plane that is normal to the central axis. These vanes extend outwardly to respective outriggers 105, 106, to which they are attached. The outriggers may be flat or somewhat convex on their outer surface. They are preferably set at an angle tangent to the theoretical cylinder they generate. An angle of about 15 degrees is useful.

Braces 110, 111 join the outriggers to the central shaft. They extend outwardly, are blade-like, and also are inclined (canted) at an angle to a plane normal to the central axis perhaps by about 15 degrees. While not necessary, they contribute to the mixing action of the head when used.

Secondary vanes 112, 113 extend from the central shaft above the braces, also similarly canted. Preferably they extend in a different plane orientation than vanes 102 and 103. The secondary vanes are optional.

All blades and vanes have confronting edges- they are the leading edges when the tool is rotated in their respective directions. These edges may be blunt or chamfered as desired. When sharpened they assist in cutting organic material.

Water port 115 and binder port 116 are formed in hollow shaft 101 with appropriate connections to their respective supply. It will be observed that water port 115 discharges near the lower end of the head.

The left hand portion of FIG. 1 schematically shows the process of this invention. The downward movement is referred to as the downward leg 90. The upward movement is referred to as the upward leg 91. Between these legs are optionally provided intermediate legs 92. The associated arrows indicate the direction of movement through various soil zones such as zones 93,94,95, which may be such as sand, shale and clay, respectively. Line 96 indicates bed rock or some other geological structure that the piling is intended to rest on.

Figure 5:
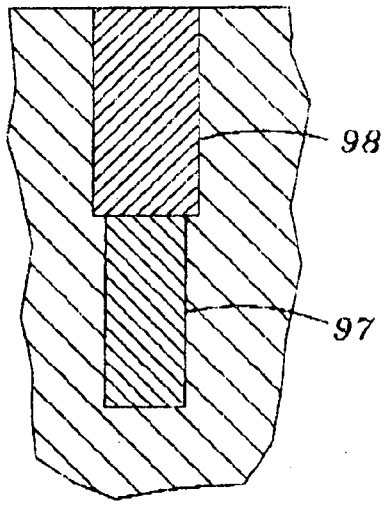
FIG. 5 is an axial cross-section of an in-situ piling atop an inserted piling.

Some installations may be deeper than desirable for this process. FIG. 5 shows a wood or cement piling 97 driven or placed below an in-situ piling 98 that later is formed atop it. This illustrates the versatility of this invention.

Returning to FIG. 1, the direction and rotational velocity of the tool is shown for the downward leg by arrow 125. The direction and rotational velocity of the tool on the upward leg is shown by arrow 126. For the intermediate legs 127 when used, binder may or may not be added, and the direction of rotation is arbitrary, but the tool will be rotated during them. The purpose of the intermediate legs is to give additional assurance of correct mixing at the important bottom of the piling, and if desired to add additional binder at this point. Often it is of importance that the piling has reached a critical level and have been effectively built there, so these intermediate movements will be used.

The specific amounts of water and binder to be added depend on the composition of the soil and the amount of water already in it. These will be learned from previous investigations. With this knowledge, a program can be devised to inject the correct total amount of binder to be added during the two legs of tool movement.

Generally, only sufficient air will be used to inject the binder and to assure that the tool will not be plugged up.

Air is a necessary evil, because it is the only practical way to inject binder into the bore, but it can result in degradation of column properties if too much remains in the column.

Similarly, water is necessary for the hydration of the binder to occur. Beyond this stoichiometric amount, excess water can and does result in reduced unit strength of the cured body. However, if only the stoichiometric amount is provided, the mix often will be too stiff for sufficient mixing or for percolation of the air. In some soils these criteria are not important because of their inherent loose structure as in sand. In other types of soil it is an important consideration.

This invention accepts what may be regarded as a "degradation" of the potentially available unit properties of a given mix of binder, soil aggregate and water available for hydration of the binder. This trade off is made for the purpose of producing a pre-curing mix that is sufficiently fluid to require only reasonable amounts of energy by providing lubricity for the tool, reduction of particle size, and enabling the prompt exit of air by percolation.

This results in a column with reduced unit strength relative to the product of binder and just the stoichiometric amount of water, but with uniformity and reliability that would not otherwise exist. Thus a more reliable column can be produced with known unit properties, even though the unit value is less.

As to the amount of water required, it is greater than would be needed for hydration of the binder. However it should not be so great as to dilute the binder to such an extent that any cured structure would have too little integrity. Instead, the excess of water should only be such as to enable the desired fluidity and consistency to be attained while still retaining suitable cured properties. It will depend on analysis of the soil before the process is started.

The rotational speed of the tool is of considerable importance. The rotational velocity in the downward leg should be just sufficient to divide the soil and not to stall. The function of the downward leg is principally to prepare the soil for reduction in particle size and to have in place part of the cement needed at the various levels (sometimes called "zones"), along with some of the water.

Generally, for pilings of practical size, rotational velocities of at least about 100 rpm have been found sufficient for the downward leg 90. Slower speeds often can result in the tool's stalling in some formations, requiring abandonment of the tool head or a slow and costly removal operation. The cost of an abandoned tool, or the time and effort spent in recovering a stalled tool can be costly to a project.

In the upward leg 91 (and with intermediate legs 22 if used), the situation is otherwise. While the rotational rate need not be increased, the need for increased contact with the mix will be fostered by a somewhat faster rotation. Therefore it is usually useful to provide a higher rate of rotation in the intermediate and upward legs. The rate of withdrawal in this powered leg need not be, but can be faster than the rate of insertion in the downward leg.

To Summarize:

The in-situ piling is formed by the tool, rotating at a rate above its stalling condition, injecting water and part of the binder during the downward leg, and during the upward leg, injecting the remainder of the binder and water, operating the tool in the reverse rotational direction and at a rotational velocity and rate of withdrawal of the tool to fragment and stir the resulting mixture, with an amount of water in excess of the stoichiometric amount sufficient to assure fluidity of the mixture to enable percolation of air from it.

This invention is not to be limited by the embodiment shown in the drawings and described in the description, which are given by way of example and not of limitation, but only in accordance with the scope of the appended claims.

I claim:

1. A method of preparing an in-situ piling in soil, the soil which occupies the situs of the intended piling constituting aggregate soil into which binder and water will be mixed to form said piling, said method utilizing a tool having a central axis of rotation, said tool having a head adapted selectively to be driven rotationally in both directions around said axis, and selectively driven axially in both directions along the axis, said head including at least two blades extending radially away from said axis, said blades depending at an angle relative to a plane normal to the axis so as to tend to move into the soil when rotated in a first direction, pressing down into it, and cutting into the soil, and to move into substances above it when turned in a second, opposite rotational direction and drawn axially upward, said blades having confronting edges, said method comprising the following steps in the order recited:

a. rotating the tool in said first direction, while forcing the head into the soil in the situs, injecting water into the bore at said head to provide water to provide lubrication for the blades and for incorporation in an interface formed in the soil when it is pierced by the blades, and also to provide at least part of the water needed for hydrating binder that is to be injected into the situs;

b. during step a, injecting from the tool into the situs less than the amount of binder ultimately required to form the piling, at a rate of supply along the length of the intended piling respective to the anticipated amount of binder required for bonding of the type of soil at respective depths to form a piling, said binder being injected along with air under pressure;

c. after finishing step b, rotating the head in said second direction and pulling it from the situs, while adding additional binder and water in an amount at each depth which with the binder and water already added in steps a and b will provide a stoichiometric mixture of binder, soil, and water and also water in excess of the stoichiometric requirement, along with air under pressure used to inject said binder;

d. the rate of axial removal of the tool and its rate of rotation in step c relative to the rotation and rate of entry of the tool in step a being such that the vane will have impacted substantially the entire volume of material in the situs, thereby thoroughly to mix the material and reduce the particle size of the soil;

e. removing the tool from the situs and permitting the mixed materials to cure to form the in-situ piling, the amount of water supplied during steps a, b, c and d being in substantial excess of the amount required to furnish sufficient water for stoichiometric hydration, and sufficient that in step d, the mixture of binder, aggregate and water is sufficiently fluid that a substantial portion of the air which was injected in steps b and c can percolate through the mixture to the surface and escape from the mixture.

2. A method according to claim 1 in which said blades are canted at an angle between about 10 degrees and 20 degrees relative to said normal plane.

3. A method according to claim 1 in which binder and water are injected into the situs from a central shaft to which said vanes are attached, said binder and water being discharged into the situs radially, under pressure.

4. A method according to claim 1 in which an outrigger is attached to each blade at its end remote from the axis, said outrigger extending axially, to define the outer boundary of the core, said outriggers having confronting edges.

5. A method according to claim 4 in which said outrigger is canted relative to an axial plane normal to the vane, whereby to shave the outer boundary of the bore in steps a and b, and to compact the outer boundary in steps c and d.

6. A method according to claim 4 in which a pair of secondary vanes extends from said axis above said blades and outriggers.

7. A method according to claim 1 in which the speed of rotation in both of said steps a and c being at least 100 rpm.

8. A method according to claim 7 in which the rotation in step c is faster than the rotation in step a.

9. A method according to claim 6 in which water is injected axially below where the binder is injected.

10. A method according to claim 1 in which a program is supplied to the user specifying the amount of binder to be provided at each depth, and control valves for controlling the supply of water are provided to supply the prescribed amounts of water and binder.

11. A method according to claim 10 in which the program further specifies the lesser amount of binder and water to be used in each of steps a and c to provide correct total amounts for each depth, but lesser amounts in each step.

12. A method according to claim 1 in which the angle at which the blades depend from said normal place drop in the direction of rotation in step a.

13. A method according to claim 1 in which driven hollow central shaft to which said blades are attached house supply conduits for said binder and water, with ports from said conduits opening outwardly from said shaft.

14. A method according to claim 1 in which an inserted piling is placed beneath the intended situs of the in-situ piling, and the in-situ piling is formed atop the said piling.

* * * * *